United States Patent [19]

Erdmann et al.

[11] Patent Number: 4,523,251

[45] Date of Patent: Jun. 11, 1985

[54] ELECTRONIC APPARATUS COMPRISING AN INPUT STAGE WITH A BINARY OUTPUT CONNECTED TO A RELAY CONTROL CIRCUIT

[75] Inventors: Jürgen Erdmann; Karl O. Buchholz; Hartmut Knappe, all of Waldkirch, Fed. Rep. of Germany

[73] Assignee: Erwin Sick GmbH Optik-Elektronik, Waldkirch, Fed. Rep. of Germany

[21] Appl. No.: 425,217

[22] Filed: Sep. 28, 1982

[30] Foreign Application Priority Data

Oct. 13, 1981 [DE] Fed. Rep. of Germany ..... 3140682
Feb. 8, 1982 [DE] Fed. Rep. of Germany ..... 3204234

[51] Int. Cl.[3] ..... H01H 47/32

[52] U.S. Cl. ..... 361/152; 361/175; 307/132 E

[58] Field of Search ..... 361/152, 170, 173, 175; 307/117, 132 E, 132 EA

[56] References Cited

U.S. PATENT DOCUMENTS

| | | | |
|---|---|---|---|
| 3,878,439 | 4/1975 | Crozier | 361/175 |
| 4,293,888 | 10/1981 | McCarty | 361/152 |
| 4,358,812 | 11/1982 | Lo Cascio et al. | 361/152 |
| 4,399,483 | 8/1983 | Phelan | 361/152 X |

FOREIGN PATENT DOCUMENTS

| | | | |
|---|---|---|---|
| 2000117 | 7/1971 | Fed. Rep. of Germany . | |
| 2420262 | 6/1975 | Fed. Rep. of Germany . | |
| 2447199 | 3/1976 | Fed. Rep. of Germany . | |
| 2821624 | 11/1979 | Fed. Rep. of Germany . | |
| 164416 | 12/1981 | Japan | 323/283 |

*Primary Examiner*—A. D. Pellinen
*Assistant Examiner*—Derek S. Jennings
*Attorney, Agent, or Firm*—Townsend and Townsend

[57] ABSTRACT

An electronic apparatus has an input stage (11) with a binary signal output (19). This signal output is connected to a relay control circuit which deenergizes or energizes the relay (15) in dependence on the output signal (0 or 1). The relay (15) can be held in the energized condition over a wide voltage range, without being overloaded, by a periodically limited energizing current. This is achieved, by way of example, by energizing the relay via a semiconductor switching device (transistor 14) which can be switched on and off by a Schmitt trigger (12) connected to the binary signal output. A capacitor (17) charged in dependence on the energizing current flowing through the relay is used to override the signal from the binary output (19) to switch the transistor (14) via the Schmitt trigger (12) so as to periodically energize the relay (15) (FIG. 1).

3 Claims, 2 Drawing Figures

Figure 1:
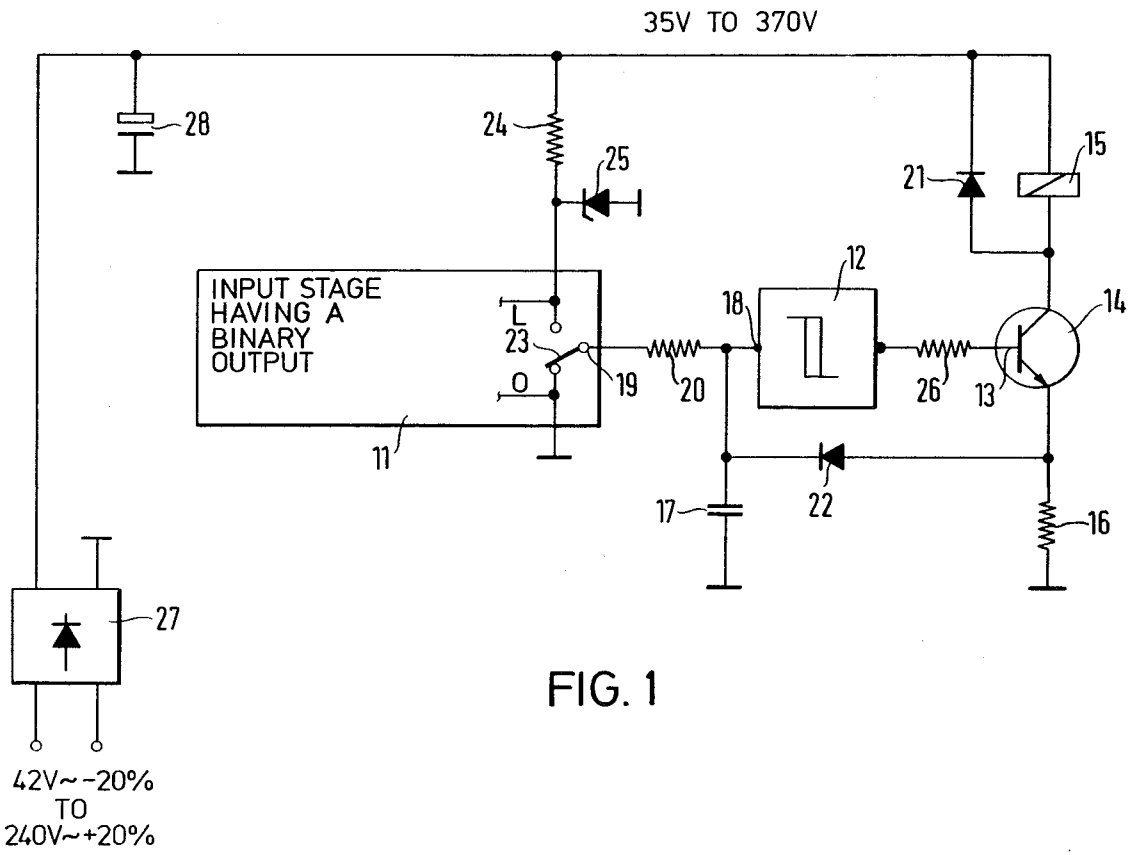

ELECTRONIC APPARATUS COMPRISING AN INPUT STAGE WITH A BINARY OUTPUT CONNECTED TO A RELAY CONTROL CIRCUIT

The invention relates to an electronic apparatus comprising an input stage with a binary output connected to a relay control circuit, which, on the appearance of one of the output signals deenergises a relay and, on the appearance of the other of the output signals, energises the relay.

It is already known to operate relays directly with the nominal supply voltage. The maximum voltage tolerance must not however amount to more than ±20% because otherwise, if it is less than this voltage tolerance, the relay will no longer engage or, in the other case, will be thermally overloaded.

In addition relays have also been operated via a voltage regulator using a supply voltage with a large range of tolerance. This known circuit does not however operate economically because large power losses occur in the voltage regulator when the supply voltage range is large. By way of example the power loss can amount to approximately 3.5 W which would no longer be tolerable for small devices for which the invention is primarily intended.

Finally, it is also already known to connect a relay to a supply voltage with a large range of tolerance via a switching regulating power supply. This type of circuit cannot however be used for very small apparatus for space and price reasons.

The electronic apparatus to which the invention is particularly directed can comprise, by way of example a miniature light barrier which produces the output signal L or O, depending on whether the light barrier beam is interrupted or not, in order to thereby control the monitoring relay.

The invention brings about a low loss relay control for a large supply voltage range from, for example, 35 V to 370 V DC. The AC voltage required for this purpose thus lies in the range from 42 V−20% to 240 V+10% AC prior to rectification.

The principal object underlying the present invention is thus to provide electronic apparatus of the initially named kind which can be used with a very large range of supply voltages, with minimal power consumption and small space requirements, without the danger of the relay being overloaded or dropping out at the wrong time.

In order to satisfy this object the invention envisages that the output of the input stage is connected via an electronic threshold switch to the control electrode of a semiconductor switching component, in particular a transistor which determines the flow of current through the relay; and that the threshold switch is periodically switched over in dependence on the current flowing through relay, with the semiconductor switching component being thereby made alternately conductive and non-conductive, in such a way that the relay is periodically energised by a current continuously increasing from zero, is switched off each time a predetermined current is reached and is again reenergised with the increasing current shortly before it drops out.

The arrangement should preferably be such that a voltage corresponding to the current through the relay is tapped off at a resistor lying in the energising circuit of the relay and is passed to the input of the threshold switch.

The output of the input stage is expediently connected to the input of the threshold switch via a second resistor. A capacitor is usefully associated with this second resistor to form an RC circuit.

It is particularly useful if the time constant of the capacitor and the resistor is selected so that the voltage at the input of the threshold switch falls below the switching threshold before the preselected mean value of the current flowing in the relay falls below the retaining current.

A diode should be connected parallel to the relay opposite to the forward direction of the semiconductor switching element. After the relay has been switched off from the supply voltage the energy stored in the magnetic field of the relay flows through this diode. In this way the preselected mean value of the current flowing through the relay is buffered so that it does not fall below the retaining current.

The threshold switch used in accordance with the invention is preferably a Schmitt trigger.

A diode can advantageously be connected into the line leading from the resistor which carries the relay current, with a polarity such that a current can flow from this resistor to the input of the threshold and/or to the charging capacitor.

The transistor should, in accordance with the invention, in particular be an npn-transistor.

A first practical embodiment is characterised in that the semiconductor switching element is connected in series with the relay and indeed in such a way that the relay is arranged between the collector of the semiconductor switching element and the high voltage. In this arrangement the resistor carrying the relay current should be connected between the emitter of the semiconductor switching element and earth.

A further embodiment is characterised in that the emitter of the semiconductor switching element is connected to earth and the collector of the semiconductor switching element is connected to the high voltage via a voltage divider; and in that the relay is connected via a semiconductor component of reverse conductivity type, in particular a pnp-transistor, with the base of the further semiconductor component lying at the dividing point of the voltage divider.

As a result of the construction in accordance with the invention the energising current for the relay is periodically switched in and out via the transistor and indeed in such a way that the relay always remains engaged but is however never overloaded.

Figure 2:
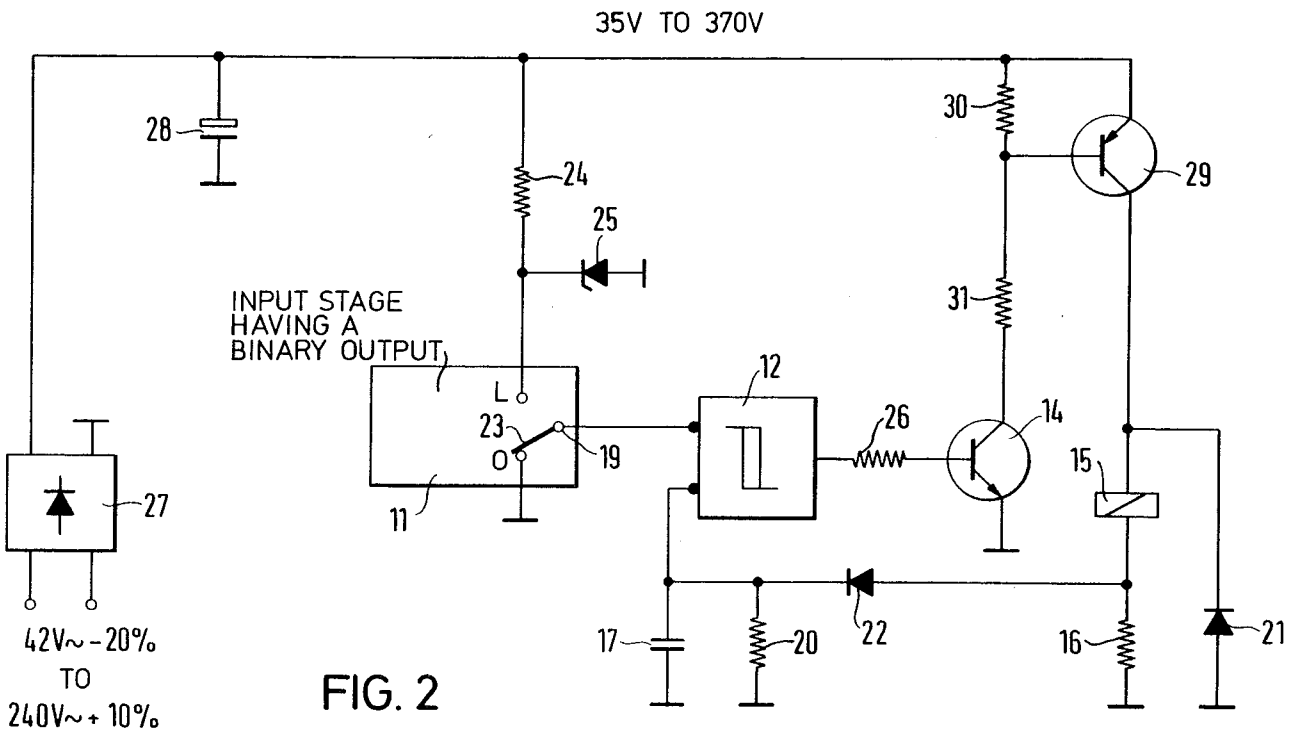

The invention will now be described in further detail by way of example only and with reference to the drawings which show:

FIG. 1 is a schematic circuit diagram of a first embodiment of an electronic apparatus in accordance with the invention, and FIG. 2 is a schematic circuit diagram of a further embodiment.

The input stage 11 of the electronic apparatus, which is not described in detail, can for example be a light barrier. The input stage 11 is expediently executed using MOS technology whereby it is possible, because of the low power requirement, to step down the high supply voltage with dropping resistors.

As seen in FIG. 1 either the signal L or the signal O is present at the output 19 of the input stage depending, for example, on whether an obstacle is present in the beam of the light barrier or not. The output 19 is represented as one pole of a switch arm 23 which can be connected by choice either—as illustrated—to earth or to a voltage derived from the supply voltage and stabilised via a resistor 24 and a zener diode 25.

The input 18 of a Schmitt trigger 12 is connected to the output 19 via a resistor 20. The output of the Schmitt trigger feeds the base of an npn-transistor 14 via a further resistor 26. The transistor is inserted in the energising circuit of a relay 15 which is connected at one end to the DC supply voltage of from 35 V to 370 V. The other pole of the relay 15 is connected to the collector of the transistor 14. The emitter of the transistor 14 is connected to earth via a resistor 16. The connection point between the emitter of the transitor 14 and the resistor 16 is connected via a diode 22 poled in the illustrated manner to one pole of a capacitor 17 which is earthed at its other pole and also to the input 18 of the Schmitt trigger 12. The DC supply voltage of from 35 V to 370 V is delivered by a rectifier 27 to the input of which an AC voltage of from 42 V−20% to 240 V+20% can be applied. One output terminal of the rectifier 27 is connected in the illustrated manner to earth. A capacitor 28 between the DC supply voltage and earth serves for voltage smoothing.

The manner of operation of the circuit described with reference to FIG. 1 is as follows:

When the beam of the light barrier is uninterrupted the switch arm 23 at the output of the input stage of the electronic apparatus of the invention may lie in the upper switched position as shown in the drawing. In this case a positive voltage is connected to the input 18 of the Schmitt trigger 12 via the resistor 20. In this way the Schmitt trigger may be located in its lower switch position so that a voltage is present at its output which is sufficiently low that the transistor 14 is made non-conductive via the base 13, so that no current flows through the relay 15. The relay 15 is thus in the dropped out condition when the switch arm 23 of the input stage 11 is in the upper switch position.

If an obstacle is now introduced into the beam of light barrier the switch arm 23 may be switched over into the lower position shown in the drawing so that the output 19 of the input stage 11 is at earth potential. As a result of the voltage jump occurring in this way at the input 18 of the Schmitt trigger 12 the latter switches from its low to its high voltage stage so that an increased voltage is passed to the base 13 of the transistor 14 via the resistor 26 which switches the transistor 14 into the conductive state. A continually increasing current now flows through the transistor and accordingly through the relay 15 and also the resistor 16.

As a result of the flow of current through the resistor 16 an increasing voltage is present across this resistor which charges the capacitor 17 via the diode 22. As a result the voltage at the input 18 of the Schmitt trigger 12 increases continuously until the switching threshold of the Schmitt trigger 12 is exceeded. The output of the Schmitt trigger 12 now switches from its upper state into the lower state, although the switch arm 23 remains in its earthed position. The transistor 14 now switches off and the current flowing through the relay 15 and the resistor 16 is interrupted. However, a counter EMF is now generated in the relay 15 which maintains the magnetic field via the diode 21 for a specified time so that the relay 15 remains engaged.

The time constant of the resistor 20 and of the capacitor 17 is now selected in accordance with the invention so that, after the current through the resistor 16 has been interrupted, the voltage at the input 18 of the Schmitt trigger 12 falls below the switching threshold of this trigger before the current through the relay 15 falls below the preselected mean value. In this way the transistor 14 is once again made conductive in sufficient time for the relay 15 to remain engaged as a result of a renewed flow of current.

In other words, the capacitor 17 discharges via the resistor 20 during the interruption of the flow of current, and with the switch arm 23 connected to earth, just fast enough that dropping out of the relay 15 is prevented.

As a result of the automatic regulation of the current through the relay 15 in accordance with the invention in such a manner that the relay is neither overloaded nor drops out when the switch arm 23 is connected to earth, the apparatus can be operated at voltages which lie in a range covering a factor of 10, for example between 35 V and 370 V. Even at increased supply voltages this circuit arrangement automatically switches the relay off from the supply voltage when the flow of current has reached a predetermined size. The subsequent interruption is so short that the relay remains engaged during this time as a result of the energy stored in the magnetic field and as a result of the inertia of the magnetic system. The described operating sequence subsequently repeats.

During the switching pauses the relay 15 is held in its engaged position as a result of the magnetic energy stored during the flow of current.

The period for which the transistor 14 is switched on thus depends amongst other things on the inductivity of the relay 15 and on the momentarily prevailing operating voltage. The current flow duration is determined by a constant preselected time constant of the capacitor 17 and of the resistor 20. A constant switching pause is present because the relay peak current remains constant for any possible operating voltage, as does the inductivity of the relay.

A further way of holding the effective relay operating current constant for different operating voltages is shown in FIG. 2 in which the same reference numerals designate parts having counterparts in FIG. 1.

In FIG. 2 the circuit is supplemented by a pnp-transistor 29 the emitter of which is connected with the high operating voltage. The relay 15 with the parallel connected diode 21 is connected from the collector of the transistor 29 to earth via the resistor 16. The collector of the switching transistor 14 is connected via a voltage divider consisting of resistors 30, 31 to the high voltage and the emitter of the switching transistor is connected to earth. The connection point between the resistors 30, 31 is connected with the base of the pnp-transistor 29.

In this manner a continuously rising and falling voltage can be found at the sensor resistor 16 in accordance with the duty cycle of the switching transistor 14. The rising voltage corresponds to the current flow phase, with the transistor 14 in the conductive state, and the reducing voltage corresponds to the cut-off state of the transistor 14. The current flowing via the free running diode 21 is the determining factor in this respect.

If the trigger 12 is replaced by a trigger having two negated inputs in AND-logic, and if the feedback voltage is brought to one input of the trigger and the switching voltage to the other input of the trigger via the diode 22 and if, in addition, the hysteresis of the trigger is so selected that the trigger switches the transistor chain off at the maximum voltage across the resistor 16 and switches it on again at the minimum voltage across the resistor 16 the mean current through the relay will be held constant independently of the operating voltage. The switching frequency is determined in this respect by the inductivity of the relay 15 and the momentarily prevailing operating voltage. The only requirement is the additional transistor 29.

We claim:

1. A relay control circuit for controlling a relay from an input stage having a binary output in the form of either a first output signal associated with an energised state of said relay or a second output signal associated with a deenergised state of said relay, the control circuit comprising:

a power source;

an energising circuit for energising said relay from said power source;

a first resistor lying in the energising circuit of said relay so that the voltage across said first resistor corresponds to the current flowing through said relay;

an electronic threshold switch having an input to which said binary output is connected via a second resistor;

a capacitor connected to said second resistor to form an RC circuit;

a semiconductor switching component determining whether or not current flows through said relay; and means for tapping off said voltage from said first resistor and passing it to said input of said threshold switch, whereby said threshold switch is periodically switched over in dependence on the current flowing through said relay, with said semiconductor switching component being thereby made alternately conductive and nonconductive, in such a way that said relay is periodically energised by a current continuously increasing from zero, is switched off each time a predetermined current is reached and is again re-energised with the increasing current shortly before it drops out.

2. A circuit in accordance with claim 1, wherein said capacitor and said second resistor form a circuit having a time constant, said time constant being so selected that the voltage at said input of said threshold switch falls below a switching threshold of said threshold switch before said relay drops out.

3. A circuit in accordance with claim 1, wherein said means for tapping off said voltage from said first resistor and passing it to said input comprises a line including a diode with its polarity such that a current can flow from said first resistor to said input of the threshold switch and to said capacitor.

* * * * *